US010215346B2

(12) United States Patent
Brannon et al.

(10) Patent No.: US 10,215,346 B2
(45) Date of Patent: Feb. 26, 2019

(54) MODULAR HIGHBAY LUMINAIRE

(71) Applicant: Hubbell Incorporated, Shelton, CT (US)

(72) Inventors: Derek E. Brannon, Greenville, SC (US); Thomas Holscher, Simpsonville, SC (US); Joseph Engle, Taylors, SC (US)

(73) Assignee: Hubbell Incorporated, Shelton, CT (US)

( * ) Notice: Subject to any disclaimer, the term of this patent is extended or adjusted under 35 U.S.C. 154(b) by 87 days.

(21) Appl. No.: 15/294,370

(22) Filed: Oct. 14, 2016

(65) Prior Publication Data

US 2017/0108186 A1 Apr. 20, 2017

Related U.S. Application Data

(60) Provisional application No. 62/242,596, filed on Oct. 16, 2015, provisional application No. 62/325,639, (Continued)

(51) Int. Cl.

| | |
|---|---|
| ***F21S 4/00*** | (2016.01) |
| ***F21S 2/00*** | (2016.01) |
| ***F21V 29/76*** | (2015.01) |
| ***F21S 4/28*** | (2016.01) |
| ***F21V 17/10*** | (2006.01) |
| ***F21V 23/06*** | (2006.01) |
| ***F21V 29/74*** | (2015.01) |
| ***F21S 8/04*** | (2006.01) |

(Continued)

(52) U.S. Cl.

CPC ..... *F21S 2/005* (2013.01); *F21S 4/28* (2016.01); *F21S 8/043* (2013.01); *F21V 17/104* (2013.01); *F21V 23/06* (2013.01); *F21V 29/74* (2015.01); *F21V 29/763* (2015.01); *F21V 31/00* (2013.01); *F21V 3/02* (2013.01); *F21V 15/015* (2013.01); *F21V 21/02* (2013.01); *F21V 23/005* (2013.01); *F21V 23/0471* (2013.01); *F21Y 2115/10* (2016.08)

(58) Field of Classification Search

CPC .... F21S 8/043; F21S 2/005; F21S 4/28; F21S 23/06; F21S 21/02; F21V 15/015; F21V 17/104; F21V 23/005; F21V 23/0471; F21V 23/06; F21V 21/02; F21V 29/763; F21V 29/74; F21V 21/005; F21Y 2115/10

See application file for complete search history.

(56) References Cited

U.S. PATENT DOCUMENTS

| | | | |
|---|---|---|---|
| 4,833,788 | A | 5/1989 | Munro |
| 5,869,786 | A | 2/1999 | Jaakkola |

(Continued)

OTHER PUBLICATIONS

PCT/US2016/057175 International Search Report and Written Opinion dated Dec. 28, 2016 (13 pages).

*Primary Examiner* — Peggy Neils

(74) *Attorney, Agent, or Firm* — Michael Best & Friedrich, LLP

(57) ABSTRACT

A luminaire includes a light housing containing a light emitter. A first rail housing is connected to the light housing. A second rail housing is connected to the light housing. A driver is positioned in the first rail housing. A male connector extends from a first end of the first rail housing and a female connector extends from a second end of the first rail housing.

20 Claims, 8 Drawing Sheets

Related U.S. Application Data filed on Apr. 21, 2016, provisional application No. 62/372,851, filed on Aug. 10, 2016.

(51) Int. Cl.

| | |
|---|---|
| ***F21V 31/00*** | (2006.01) |
| *F21V 15/015* | (2006.01) |
| *F21V 21/02* | (2006.01) |
| *F21Y 115/10* | (2016.01) |
| *F21V 3/02* | (2006.01) |
| *F21V 23/00* | (2015.01) |
| *F21V 23/04* | (2006.01) |

(56) References Cited

U.S. PATENT DOCUMENTS

| | | | | |
|---|---|---|---|---|
| 6,157,112 | A | 12/2000 | Kim et al. | |
| 6,517,222 | B1 * | 2/2003 | Orlov | F21S 8/06 248/325 |
| 6,813,853 | B1 * | 11/2004 | Tucker | G09F 9/33 340/815.45 |
| 8,628,212 | B2 * | 1/2014 | Klu | F21S 8/02 362/217.01 |
| 9,395,052 | B1 * | 7/2016 | Shew | F21K 9/27 |
| 9,897,294 | B2 * | 2/2018 | Pearson | F21V 21/008 |
| 2003/0179578 | A1 | 9/2003 | Albert | |
| 2003/0207612 | A1 | 11/2003 | McCoy | |
| 2005/0041417 | A1 | 2/2005 | Mackin | |
| 2007/0025066 | A1 | 2/2007 | Ewing et al. | |
| 2010/0254146 | A1 | 10/2010 | McCanless | |
| 2011/0211330 | A1 | 9/2011 | Wang | |
| 2013/0271011 | A1 | 10/2013 | Williams et al. | |
| 2013/0294079 | A1 | 11/2013 | Tran et al. | |
| 2014/0126190 | A1 | 5/2014 | Dixon | |
| 2014/0160747 | A1 | 6/2014 | Jang et al. | |
| 2015/0016121 | A1 * | 1/2015 | Kokubo | F21S 8/043 362/365 |
| 2015/0116997 | A1 * | 4/2015 | Tappert | A01K 63/06 362/231 |
| 2016/0327252 | A1 * | 11/2016 | Ray | F21V 21/008 |
| 2016/0327256 | A1 * | 11/2016 | Hall | F21V 23/009 |
| 2017/0108184 | A1 * | 4/2017 | Brannon | F21V 29/763 |

* cited by examiner

MODULAR HIGHBAY LUMINAIRE

RELATED APPLICATION

This application is based on U.S. Provisional Application Ser. No. 62/242,596, filed Oct. 16, 2015, U.S. Provisional Application Ser. No. 62/325,639, filed Apr. 21, 2016, and U.S. Provisional Application Ser. No. 62/372,851 filed Aug. 10, 2016, the disclosures of which are incorporated herein by reference in their entirety and to which priority is claimed.

FIELD

Various exemplary embodiments relate to light fixtures or luminaires, for example indoor luminaires.

BACKGROUND

Light fixtures, or luminaires, are used with electric light sources to provide an aesthetic and functional housing in both interior and exterior applications. For example, highbay luminaires can be used in larger open indoor environments such as heavy industrial settings, warehouses, gyms, churches, and shopping malls.

SUMMARY

According to an exemplary embodiment, a luminaire includes a light housing containing a light emitter. A first rail housing is connected to the light housing. A second rail housing is connected to the light housing. A driver is positioned in the first rail housing. A male connector extends from a first end of the first rail housing and a female connector extends from a second end of the first rail housing.

According to an exemplary embodiment, a first luminaire includes a first light housing containing a first light emitter. A first rail housing is connected to the first light housing. A second rail housing is connected to the first light housing. A first male connector extends from a first end of the first rail housing and a first female connector extends from a second end of the first rail housing. A second luminaire has a second light housing containing a second light emitter. A third rail housing is connected to the second light housing. A fourth rail housing is connected to the second light housing. A second male connector extends from a first end of the third rail housing and a second female connector extends from a second end of the third rail housing. The first female connector of the first rail housing is connected to the second male connector of the third rail housing.

Another exemplary embodiment is directed to a method of assembling a luminaire. A first rail and a second rail are selected. The first rail includes a male connector and a female connector. A first light bar assembly is connected to the first rail and the second rail. A second light bar assembly is connected to the first rail and the second rail. A control component assembly is connected to the first rail and the second rail. The first and second rails, the first and second light bar assemblies, and the control component assembly form a first luminaire section. A driver is positioned in either the first rail or the second rail. The position of the driver is adjusted based on the position of the first light bar assembly, the second light bar assembly, and the control component assembly to balance the first luminaire section.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
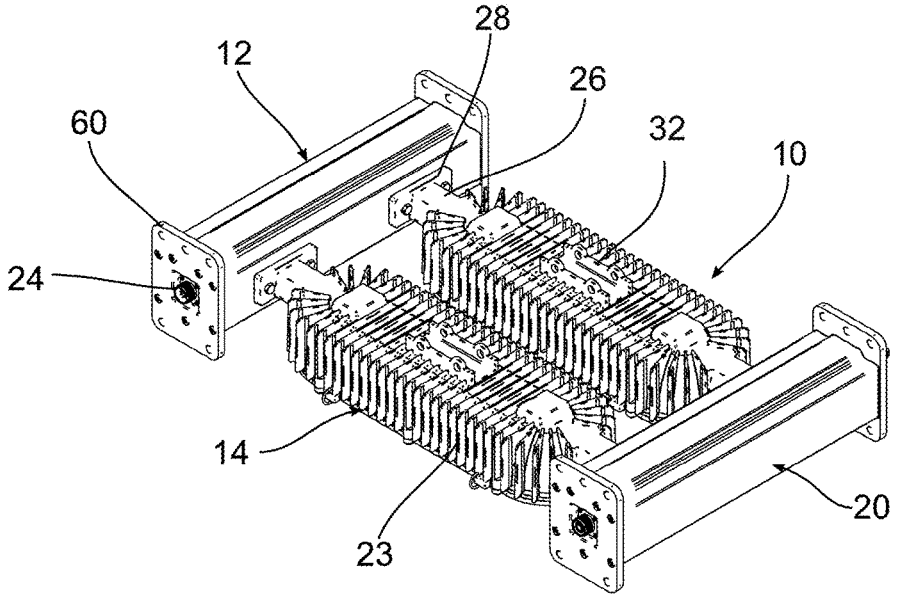
FIG. 1 is a perspective view of an exemplary luminaire.

According to various exemplary embodiments, a luminaire includes one or more light bar assemblies 10 connected to a pair of rail assemblies 12. The light bar assembly 10 can include a light housing 14, a lens assembly 16, and a light emitter 18 that is contained in the light housing 14. The rail assembly 12 can include a rail housing 20 containing one or more drivers 22 and a connector 24 for electrically connecting the driver 22 to a power source or for electrically connecting to another luminaire.

The illustrated exemplary embodiment shows a light housing 14 having a substantially oval configuration with a plurality of fins 23 for dissipating heat generated by the light emitter 18. Any size, shape, or configuration of light housing 14 can be used and the size, type, spacing, and configuration of fins 23 can be varied as needed. The spacing between the light housings 14 can be adjusted to achieve a desired light output. The light housing 14 can be made from a variety of materials and by a variety of manufacturing processes, for example cast aluminum.

Figure 2:
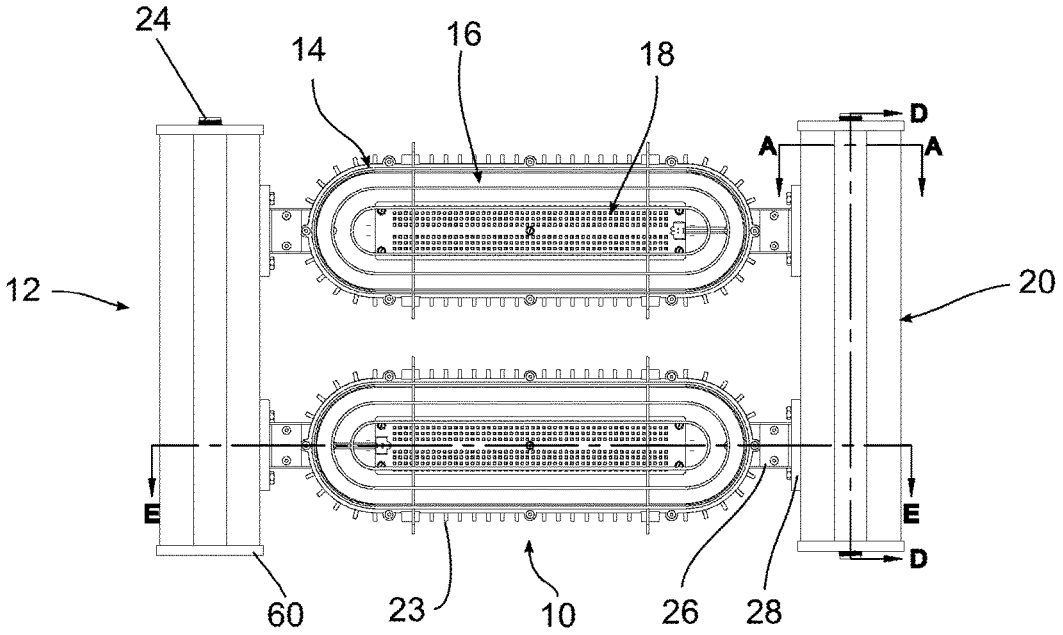
FIG. 2 is a bottom view of the luminaire of FIG. 1.
Figure 4:
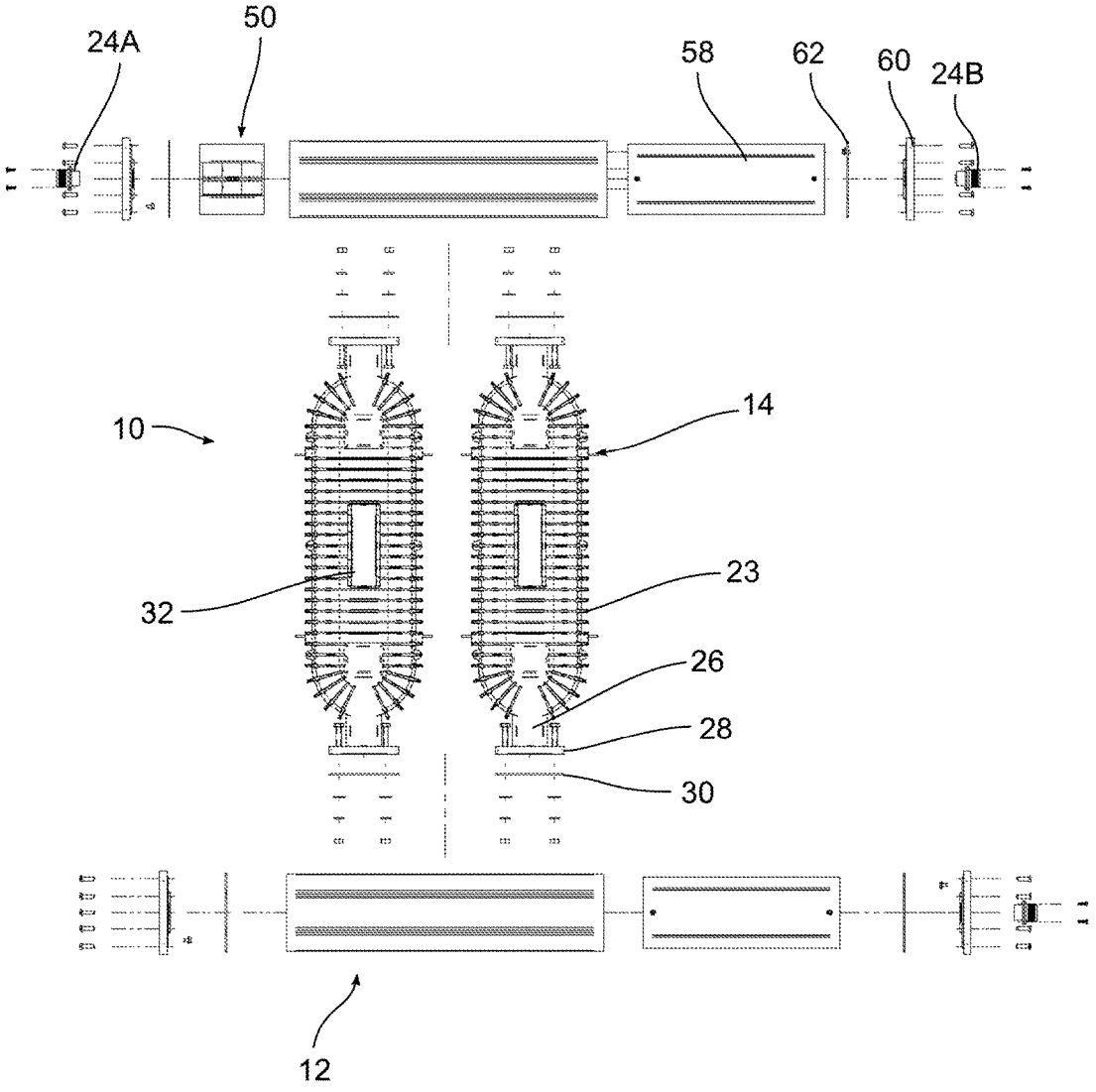
FIG. 4 is a top, exploded view of the luminaire of FIG. 1.

As best shown in FIGS. 1, 2, and 4, the light housing 14 includes a pair of arms 26 and connecting plates 28 at each end to connect the light housing 14 to the rail housing 20 using one or more mechanical fasteners. Other suitable connections can be used, including various mechanical interfaces or joining processes such as welding. In certain embodiments the light housing 14 and the rail housing 20 may be integrally formed. A gasket 30 can be placed between the connecting plate 28 and the rail housing 20. The light housing 14 can also include a mounting feature 32 for connecting the light housing 14 to a support, such as a cable or mounting bracket.

Figure 3A:
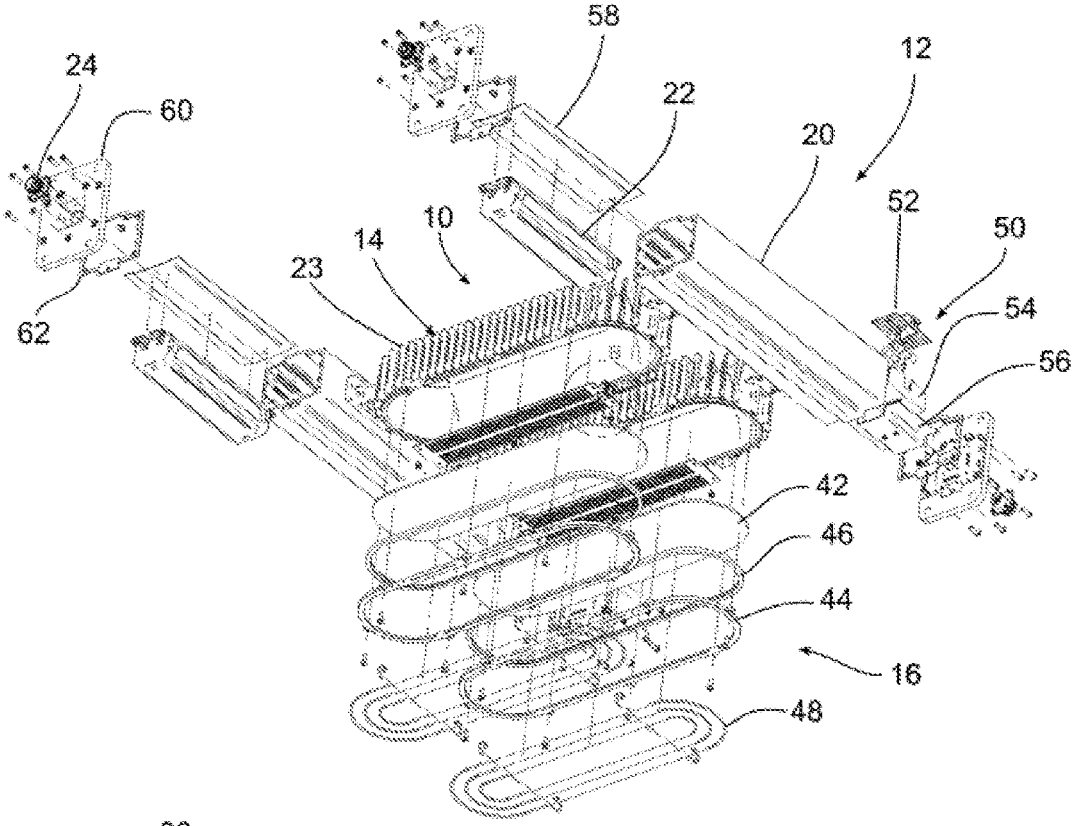
FIG. 3A is a perspective, exploded view of the luminaire of FIG. 1.
Figure 3B:
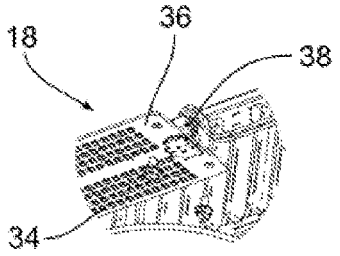
FIG. 3B is a enlarged, detailed view of area B of FIG. 3A.

In various exemplary embodiments, the light emitter 18 is an LED array that includes a plurality of LEDs 34 mounted on a printed circuit board 36 (PCB) as best shown in FIGS. 3A and 3B. A connector 38 also extends from the PCB 36. The number, size, spacing, and configuration of the LEDs 34 on the PCB 36 can be varied depending on light output and thermal management considerations. The PCB 36 connects to the light housing 14, for example through one or more mechanical fasteners, and a recess receives the connector 38. A wireway 40 can extend through the light housing 14 to allow one or more conductors to extend from the rail housing 20 to the light housing 14 and electrically connect the light emitter 18 to a driver 22.

According to an exemplary embodiment, the lens assembly 16 includes a lens 42 that can be connected to the light housing 14 to cover the light emitter 18. The lens 42 can also direct or diffuse the light output from the light emitter 18. A frame 44 connects to the light housing 14, for example through one or more mechanical fasteners, and holds the lens 42 in place. A gasket 46 may be placed between the frame 44 and the lens 42. A wire guard 48 can be placed over the lens 42 to provide additional protection.

Figure 5:
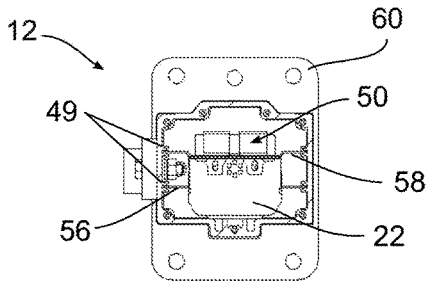
FIG. 5 is a sectional view of the luminaire of FIG. 2 taken along line A-A.
Figure 6:
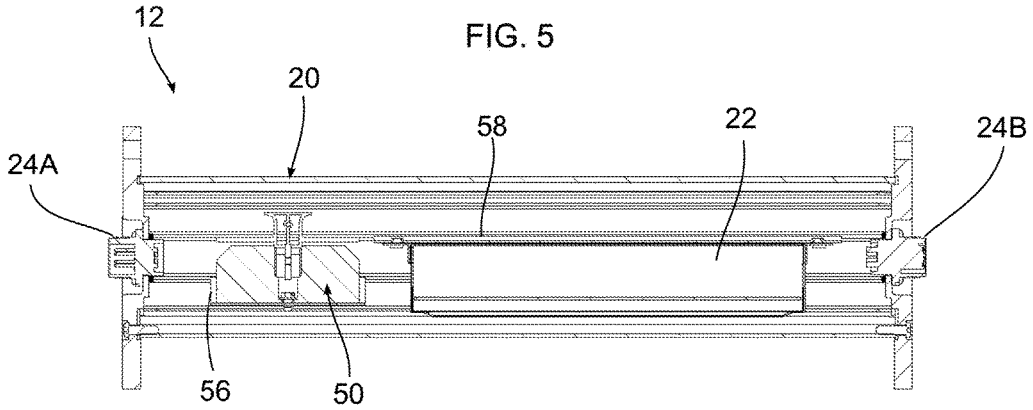
FIG. 6 is a sectional view of the luminaire of FIG. 2 taken along line D-D.
Figure 7:
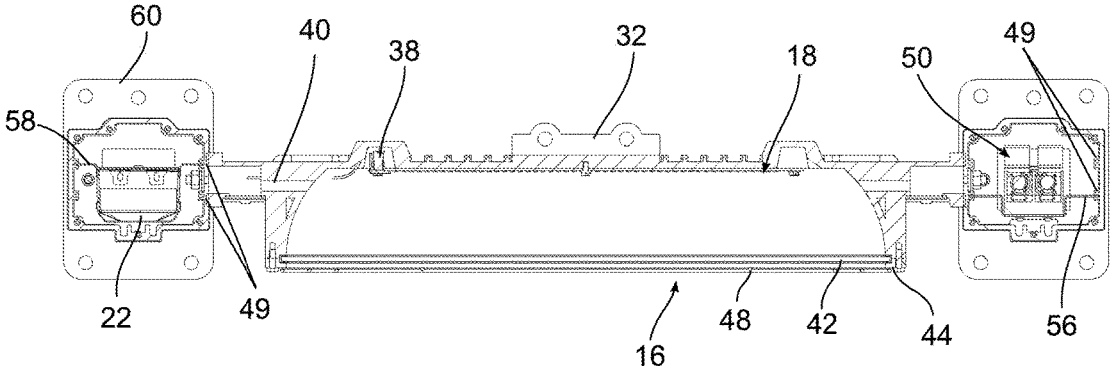
FIG. 7 is a sectional view of the luminaire of FIG. 2 taken along line C-C.

As best shown in FIGS. 5-7, the rail housing 20 includes a substantially rectangular cross-section with a hollow interior. Various internal structure extends into the interior to attach or secure different components in the rail housing 20. For example, opposite sets of protrusions 49 at least partially define opposite channels that can slidably receive brackets. As best shown in FIGS. 5 and 7, the rail housing 20 can include an upper channel and a lower channel. Other grooves, slots, or apertures can extend into the interior. Alternative sizes, shapes, or configurations of rail housings can also be used, as well as different connection methods.

The rail housing 20 can be used to contain various control components for the light emitters 18. As best shown in FIG. 3, a fuse assembly 50 can be positioned in the rail housing 20. The fuse assembly 50 can include one or more fuse elements 52 connected to a fuse holder 54. The fuse holder 54 is connected to a fuse bracket 56 that connects to the rail housing 20, for example by slidably engaging the upper or lower channel. One or more drivers 22 can be positioned in the rail housing 20, although in certain embodiments one or more of the rail housings 20 can be left empty. The number of drivers 22 depends on the number of light bar assemblies 10 used in the luminaire and the desired light output. A driver 22 is connected to a driver bracket 58, for example using one or more fasteners, and the driver bracket 58 is placed in the rail housing 20. In the exemplary embodiment shown, the driver bracket 58 slidably engages the upper or lower channel.

According to the exemplary embodiment, a pair of endplates 60 connect to the main body of the rail housing 20, for example using one or more fasteners. The endplates 60 can include one or more openings to receive a support feature, for example a cable. A gasket 62 can be positioned between the end plates 60 and the main body. In an exemplary embodiment, a connector 24 extends through each endplate 60, although alternative configurations can utilize fewer connectors 24. The connector 24 is used to connect the luminaire to a power source and to connect the luminaire to other similar luminaires. Male connectors 24A can be used on one side of the luminaire and female connectors 24B on the other side so that similar luminaires can be easily mated with one another. The rail assemblies 12 of the adjacent luminaires can be connected, for example with mechanical fasteners attaching the respective endplates 60. The connectors 24 can be recessed so that the endplates 60 can be positioned flush with one another. Different types of connectors 24 can be used, including various industry standard connectors.

Figure 8:
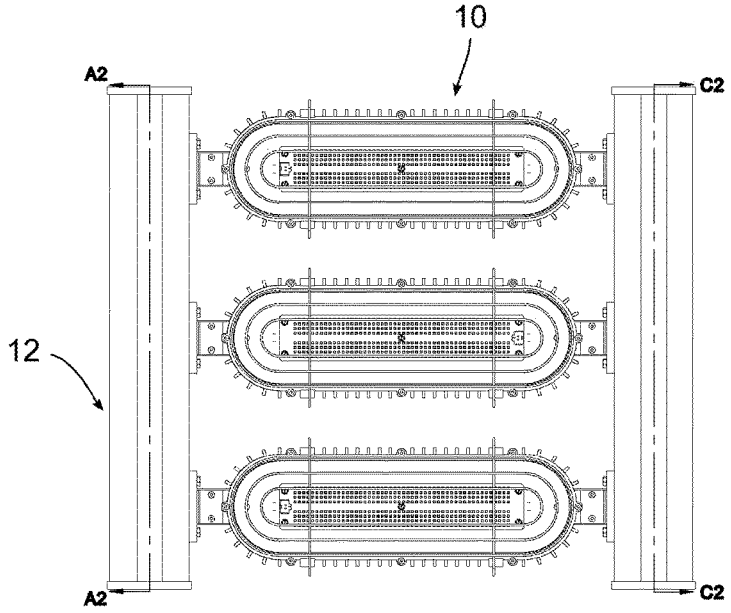
FIG. 8 is a bottom view of another exemplary luminaire.
Figure 9:
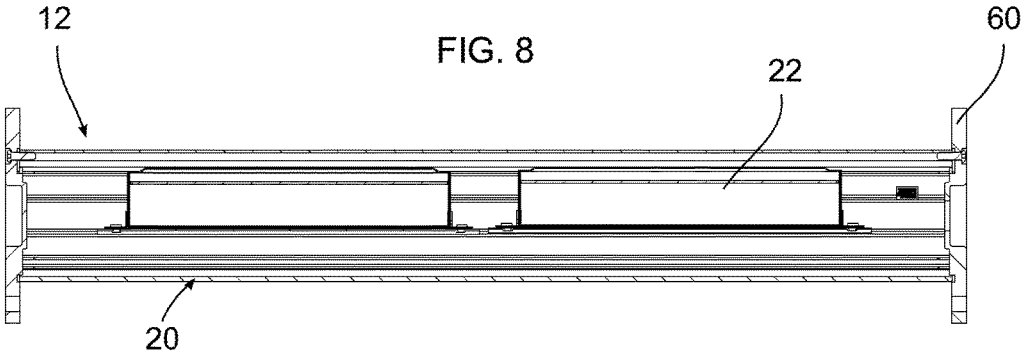
FIG. 9 is a sectional view of the luminaire of FIG. 8 taken along line A2-A2.
Figure 10:
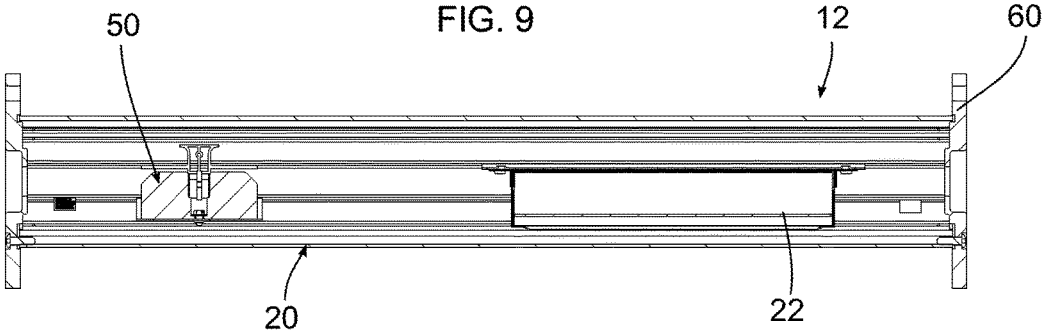
FIG. 10 is a sectional view of the luminaire of FIG. 8 taken along line C2-C2.

The number of light bar assemblies 10 used in each luminaire can vary and the number of drivers 22 can vary depending on the number of light bar assemblies 10. For example, the luminaire shown in FIG. 1 includes two light bar assemblies 10 and utilizes two drivers 22. As best shown in FIG. 3, one driver 22 is positioned in each of the rail housings 20 to help balance the luminaire. The exemplary luminaire shown in FIG. 8 includes three light bar assemblies 10 and utilizes three drivers 22. As best shown in FIGS. 9 and 10, two drivers 22 are positioned in a first rail housing while one driver and the fuse assembly are positioned in a second rail housing 20. Although this can create an imbalance, the luminaire can be leveled through adjustments in the mounting procedure.

Figure 11:
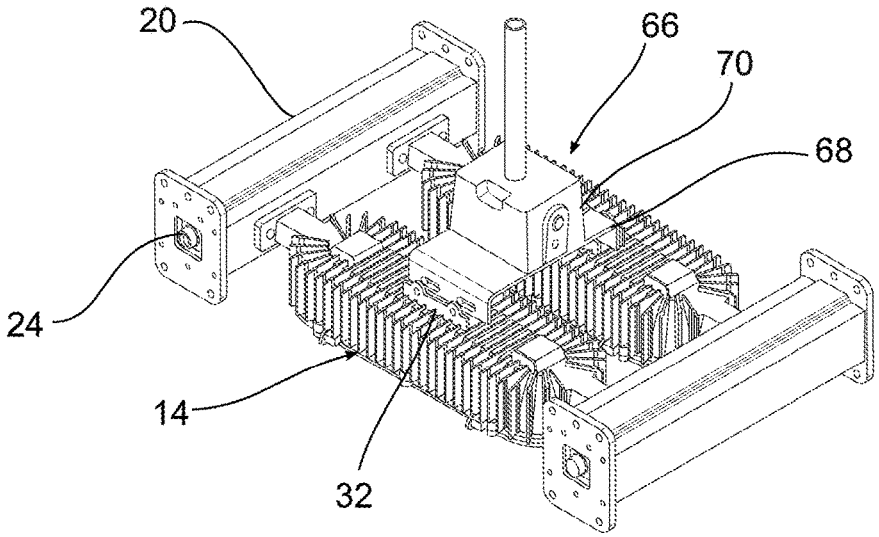
FIG. 11 is a perspective view of an exemplary luminaire and support assembly.
Figure 12:
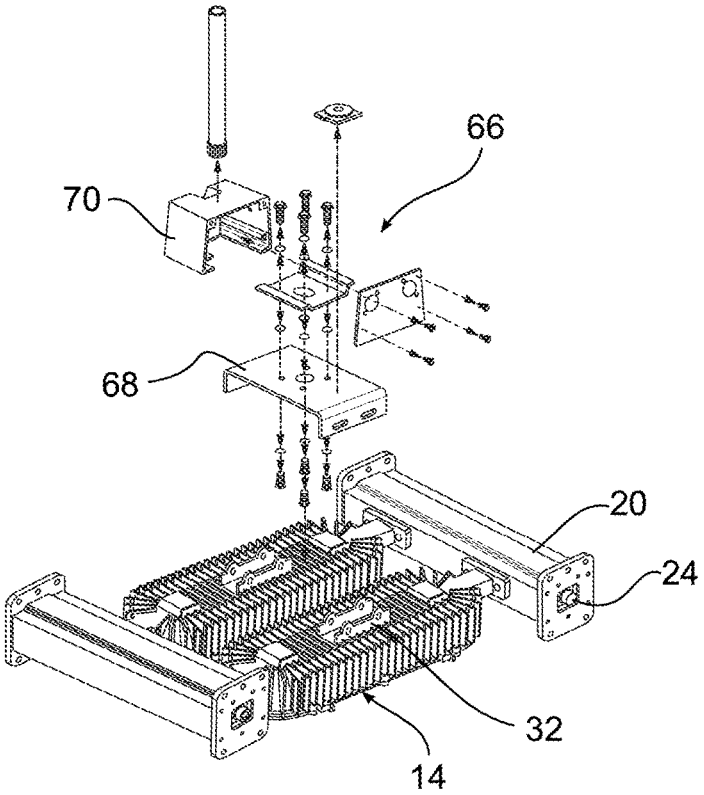
FIG. 12 is a perspective, view of the luminaire and support assembly of FIG. 11 with the support assembly exploded.
Figure 13A:
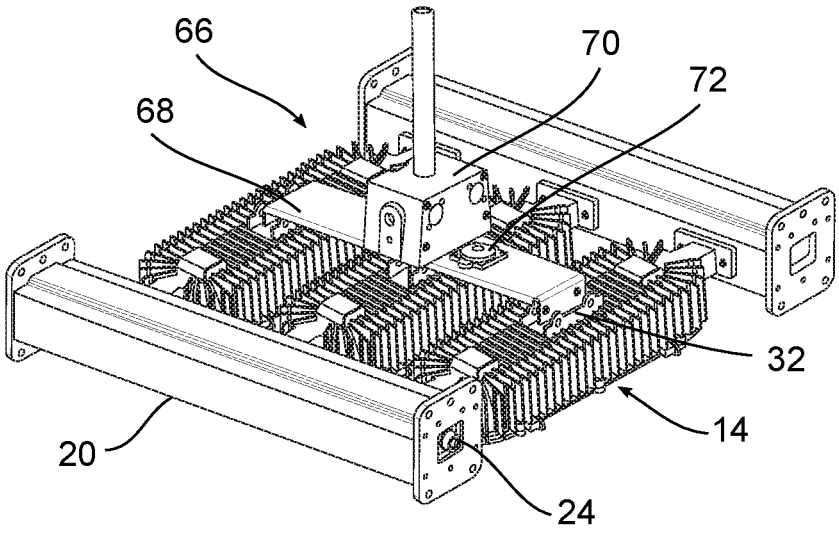
FIG. 13A is a perspective view of an exemplary luminaire and support assembly and FIG. 13B is a partial, enlarged view of the connection between the luminaire and support assembly of FIG. 13A.
Figure 13B:
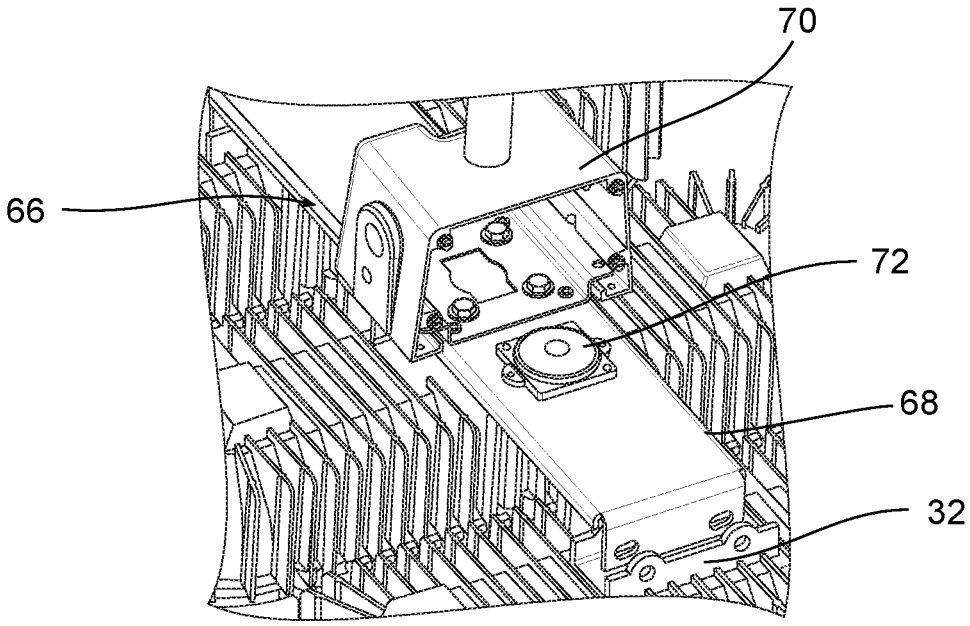

FIGS. 11-13 show an exemplary support assembly 66 suspended from a cable. The support assembly 66 includes a support bracket 68 and a support housing 70. The support bracket 68 is connected to the light housing's mounting feature 32. The position of the center of the support bracket 68 can be adjusted with respect to the cable to level the luminaire. In various exemplary embodiments, the support bracket 68 can include a level 72, such as a fluid level, to assist in installing the luminaire. The support housing 70 can act as a junction box to house electrical wiring and components. In other alternative embodiments, different mounting methods can be used, including supporting the luminaire with cables, for example attached to the endplates 60.

Multiple luminaires can be connected together to provide different light outputs over different areas. The connectors 24 can include male connectors 24A on one side of the luminaire and female connectors 24B on the other side so the luminaires can be easily mated with one another. The rail assemblies 12 of the adjacent luminaires can be connected, for example with mechanical fasteners attaching the respective endplates 60. In this manner, both a mechanical and electrical connection is provide between luminaires, although alternative configurations can be used to provide the mechanical and electrical connections. In an exemplary embodiment, only one luminaire needs to be connected directly to a power source. The position of the luminaires and the drivers can be adjusted to provide balance.

Figure 14:
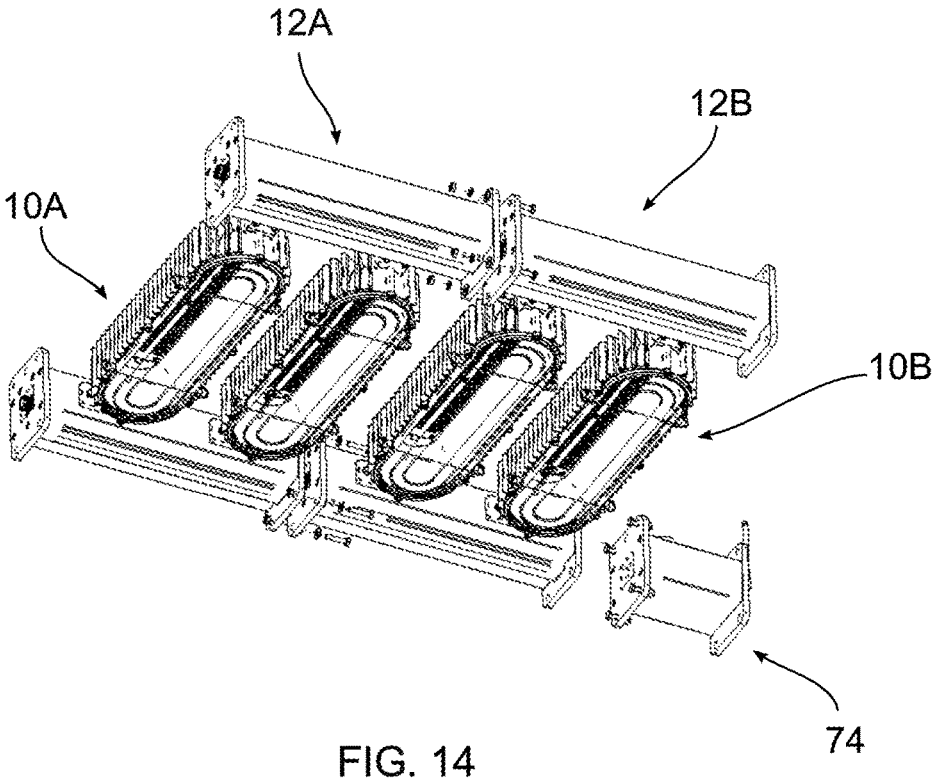
FIG. 14 is a perspective view of an exemplary luminaire combination with an accessory module.
Figure 15:
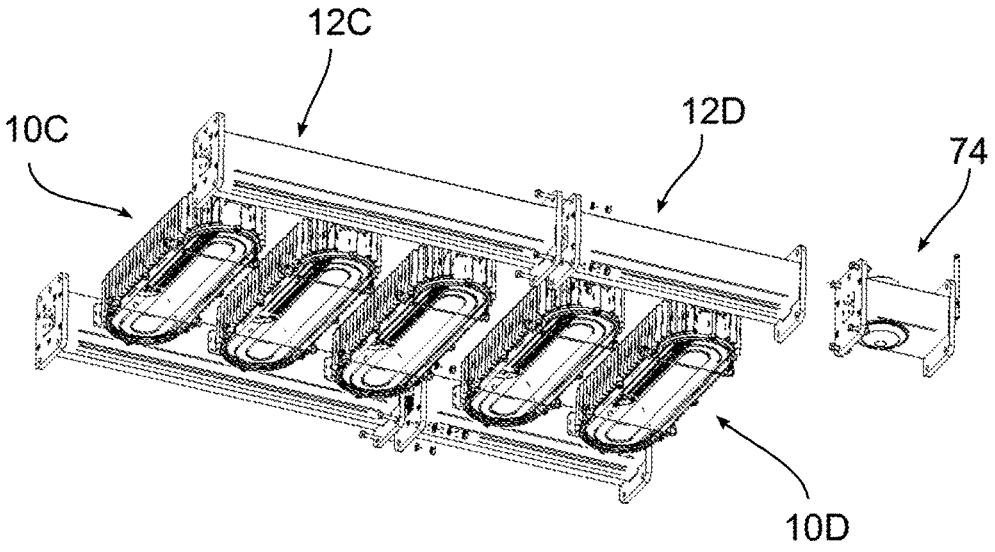
FIG. 15 is a perspective view of another exemplary luminaire combination with an accessory module.

FIG. 14 shows a first luminaire having a set of two light bar assemblies 10A connected to a set of rails 12A. The first luminaire is connected to a second luminaire having a set of two light bar assemblies 10B connected to a set of rails 12B. The rails 12A, 12B are connected to one another to form a unitary luminaire. FIG. 15 shows a first luminaire having a set of three light bar assemblies 10C connected to a set of rails 12C. The first luminaire is connected to a second luminaire having a set of two light bar assemblies 10D connected to a set of rails 12D. The rails 12C, 12D are connected to one another to form a unitary luminaire. Different combinations of one, two, three or more light bar assemblies 10 can be combined to form different luminaires. In an exemplary embodiment, each light bar assembly 10 can be capable of producing up to 10,000 lumens. A user can therefore achieve a desired light output by combining different luminaires having different numbers of light bar assemblies 10. Because individual luminaires can be easily connected to one another, a user can add or remove luminaires as desired using different combinations to achieve a desired light output.

FIGS. 14 and 15 also show an accessory module 74 that can be connected to a luminaire in the same or a similar fashion as the luminaires are connected to each other. In the exemplary embodiment shown, this can include using the same or a similar electrical connector and one or more fasteners. The accessory module 74 can include one or more of a dimmer, sensor, for example an occupancy sensor or light sensor, or other lighting accessory.

In certain exemplary embodiments the luminaires can be used in harsh environments that can include high temperatures. For example the luminaires can be used as industrial light fixtures that can survive in ambient temperatures of approximately 65 degrees Celsius. The luminaires can also be rated to be water resistant so that they can be used in damp or wet locations or washed down.

Various exemplary embodiments are also directed to a method of making or assembling a luminaire. In making a luminaire, first and second rails 12 are selected. The rails can be formed through extrusion to have a desired length. At least one light assembly 10 is connected to the first and second rails 12. One or more control components, for example drivers 22, can be positioned in the first rail, the second rail, or both the first and second rails 12 and electrically connected to the one or more light assemblies 10. A fuse assembly 50 can also be positioned in one of the rails 12. The driver 22 and fuse assembly 50 can be attached to a bracket 58 that slidably engages the rail 12. The position of the control components can be adjusted to balance the luminaire. For example drivers 22 can be positioned in each rail 20, 22. In an exemplary embodiment, this forms a first luminaire section and a second luminaire section can be similarly formed and connected to the first luminaire section. The first and second rails 12 can have a first end with a male connector 24A and a second end with a female connector 24B, allowing a third rail 12 and/or a fourth rail 12 with a male and female connector 24A, 24B to be matingly engaged. The male and female connectors 24A, 24B can extend through endplates 60 attached to the rails 12. In various embodiments, the number of light assemblies 10 connected to the rails 12 can be varied to produce different light outputs. The final luminaire can be connected to a support, for example a ceiling or wall mount. In certain embodiments, the final luminaire is balanced using a support bracket 68 and a level 72. An electrical connection can be made to the final luminaire through a junction housing 70.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a light housing containing a light emitter;

a first rail housing connected to the light housing, the first rail housing including a body, a first endplate releasably connected to the body, and a second endplate releasably connected to the body;

a second rail housing connected to the light housing;

a driver positioned in the first rail housing;

a male connector extending from the first endplate; and a female connector extending from the second endplate.

2. The luminaire of claim 1, wherein the light housing includes an arm and a connecting plate.

3. The luminaire of claim 1, wherein the light housing includes a wireway providing a passage to the first rail housing.

4. The luminaire of claim 1, wherein the male connector extends through the first endplate and the female connector extends through the second endplate.

5. The luminaire of claim 1, wherein a fuse assembly is positioned in the first or second rail housing.

6. The luminaire of claim 1, wherein the light housing includes a mounting feature and a support assembly is connected to the mounting feature.

7. The luminaire of claim 6, wherein the support assembly includes a level.

8. The luminaire of claim 6, wherein the support assembly is adjustably connectable to the mounting feature to adjust the position of the light housing and first and second rail housing.

9. A luminaire assembly comprising:

a first luminaire having a first light housing containing a first light emitter, a first rail housing connected to the first light housing, a second rail housing connected to the first light housing, a first male connector extending from a first end of the first rail housing, and a first female connector extending from a second end of the first rail housing;

a second luminaire having a second light housing containing a second light emitter, a third rail housing connected to the second light housing, a fourth rail housing connected to the second light housing, a second male connector extending from a first end of the third rail housing, and a second female connector extending from a second end of the third rail housing, wherein the first female connector of the first rail housing is connected to the second male connector of the third rail housing, wherein the first rail housing includes a first set of protrusions defining a first channel and a second set of protrusions defining a second channel, and wherein the driver is connected to a bracket that slidably engages the first and second channels.

10. The luminaire assembly of claim 9, wherein the first rail housing includes a first endplate and the third rail housing includes a second endplate, and the first and second endplates are bolted together.

11. The luminaire assembly of claim 9, wherein the first male connector is connected to a power source.

12. The luminaire assembly of claim 9, further comprising an accessory module is connected to the second luminaire.

13. The luminaire assembly of claim 12, wherein the accessory module includes an occupancy sensor or a dimmer.

14. The luminaire assembly of claim 9, further comprising a driver is positioned in the first rail housing.

15. The luminaire assembly of claim 14, wherein the first light housing includes a wireway for receiving a conductor that electrically connects the driver to the light emitter.

16. The luminaire assembly of claim 9, wherein the first light housing includes a first arm and a first connecting plate connected to the first rail housing and a second arm and a second connecting plate connected to the second rail housing.

17. A method of assembling a luminaire comprising:

selecting a first rail and a second rail, wherein the first rail includes a male connector and a female connector;

connecting a first light bar assembly to the first rail and the second rail;

connecting a second light bar assembly to the first rail and the second rail;

connecting a control component assembly to the first rail and the second rail, wherein the first and second rails, the first and second light bar assemblies, and the control component assembly form a first luminaire section;

positioning a driver in either the first rail or the second rail; and adjusting the position of the driver based on the position of the first light bar assembly, the second light bar assembly, and the control component assembly to balance the first luminaire section.

18. The method of claim 17, further comprising connecting a second luminaire section to the first luminaire section, wherein the second luminaire section includes a third rail having a female connector and a male connector, wherein the third rail male connector is connected to the first rail female connector.

19. The method of claim 18, further comprising connecting an accessory module to one of the first luminaire section or the second luminaire section.

20. The luminaire assembly of claim 1, wherein the first rail housing includes a first set of protrusions defining a first channel and a second set of protrusions defining a second channel, and wherein the driver is connected to a bracket that slidably engages the first and second channels.

* * * * *